US008535179B2

(12) United States Patent
Kanner et al.

(10) Patent No.: US 8,535,179 B2
(45) Date of Patent: Sep. 17, 2013

(54) BASEBALL SWING TRAINING DEVICE

(76) Inventors: David Kanner, Redondo Beach, CA (US); Anthony C. Fick, Escondido, CA (US)

( * ) Notice: Subject to any disclaimer, the term of this patent is extended or adjusted under 35 U.S.C. 154(b) by 260 days.

(21) Appl. No.: 13/179,561

(22) Filed: Jul. 10, 2011

(65) Prior Publication Data

US 2013/0012340 A1 Jan. 10, 2013

(51) Int. Cl.
*A63B 69/00* (2006.01)

(52) U.S. Cl.
USPC ..... 473/419; 473/423

(58) Field of Classification Search
USPC ..... 473/423, 422, 420, 436, 438, 147, 473/427, 429, 437; 482/89
See application file for complete search history.

(56) References Cited

U.S. PATENT DOCUMENTS

| | | | | | |
|---|---|---|---|---|---|
| 1,862,044 | A * | 6/1932 | White | ..... | 473/429 |
| 2,506,825 | A * | 5/1950 | Carlson | ..... | 235/103 |
| 4,508,339 | A * | 4/1985 | Llewellyn | ..... | 473/429 |
| 4,679,790 | A * | 7/1987 | Ham | ..... | 473/429 |
| 5,203,558 | A * | 4/1993 | An | ..... | 473/423 |
| 5,386,988 | A * | 2/1995 | Sung et al. | ..... | 473/423 |
| 5,472,186 | A * | 12/1995 | Paulsen | ..... | 473/429 |
| 5,531,438 | A * | 7/1996 | Corley | ..... | 473/429 |
| 6,458,037 | B1 * | 10/2002 | Dixon, Jr. | ..... | 473/219 |
| 8,262,516 | B2 * | 9/2012 | Fuentes | ..... | 473/429 |
| 2010/0285907 | A1 * | 11/2010 | Deschesnes et al. | ..... | 473/437 |
| 2013/0012340 | A1 * | 1/2013 | Kanner et al. | ..... | 473/429 |

* cited by examiner

*Primary Examiner* — Gene Kim
*Assistant Examiner* — M Chambers
(74) *Attorney, Agent, or Firm* — John R. Ross; John R. Ross, III

(57) ABSTRACT

A swing training device. A plurality of legs is pivotally connected to a base. A bottom support tube is rigidly connected to the base. A height adjustment tube is inserted into the bottom support tube. The height of the height adjustment tube is controlled by a height adjustment controller. A lower band holder is rigidly connected to the upper end of the height adjustment tube. A band tube is positioned between the lower band holder at its lower end and an upper band holder at its upper end. A plurality of elastic bands are connected between the lower band holder and the upper band holder. A pivot piece is rigidly connected to the upper band holder. A rotation stick having a hittable ball is pivotally connected to the pivot piece. The bottom support tube, the height adjustment tube and the band tube form a rotation axis. When a user hits the ball then the ball and the rotation stick rotate about the rotation axis in an initial rotation direction causing the elastic bands to stretch and wrap around the band tube. The elastic bands then act as a spring causing the ball and rotation stick to rotate back in an opposite direction to simulate a pitch to the user so that the user can hit again. For easy transport and storage, the rotation stick pivots downward and the legs pivot upwards so that they are all parallel with the rotation axis.

7 Claims, 14 Drawing Sheets

BASEBALL SWING TRAINING DEVICE

The present invention relates to baseball training devices, and in particular to baseball swing training devices.

BACKGROUND OF THE INVENTION

Baseball is an extremely popular sport in the United States and as so it is often referred to as America's Pastime. It begins as a youth sport with children as young as 5 or 6 years old playing the game. The kids who really like baseball will hopefully continue to play throughout their childhood. Those kids who have the best skills and interest will play for their high school team. Then only the most highly skilled will play at the college level. Only the very few elite players can then play on a professional level.

Although, most kids stop playing organized baseball prior to high school there is a very strong fan interest in the game. Parents and kids and young adults are very interested in following baseball games at the local, college and professional levels. The sport moves at a very good pace so that it is easy to follow the strategy of the game and appreciate the skill level of the players.

Baseball holds the interest of America. There is tremendous money spent on developing players starting at the youth level and all the way through the professional level. The hitter plays an extremely important role on a team. A great hitter can find his way onto a baseball team much easier than an average or below average hitter. Hence, there are many hitting training devices on the market designed to improve baseball hitting skills. However, none of these prior art products are optimum for proper training. They tend to be bulky, hard to transport, impractical to set up and costly.

What is needed is a better baseball swing training device.

SUMMARY OF THE INVENTION

The present invention provides a swing training device. A plurality of legs is pivotally connected to a base. A bottom support tube is rigidly connected to the base. A height adjustment tube is inserted into the bottom support tube. The height of the height adjustment tube is controlled by a height adjustment controller. A lower band holder is rigidly connected to the upper end of the height adjustment tube. A band tube is positioned between the lower band holder at its lower end and an upper band holder at its upper end. A plurality of elastic bands are connected between the lower band holder and the upper band holder. A pivot piece is rigidly connected to the upper band holder. A rotation stick having a hittable ball is pivotally connected to the pivot piece. The bottom support tube, the height adjustment tube and the band tube form a rotation axis. When a user hits the ball then the ball and the rotation stick rotate about the rotation axis in an initial rotation direction causing the elastic bands to stretch and wrap around the band tube. The elastic bands then act as a spring causing the ball and rotation stick to rotate back in an opposite direction to simulate a pitch to the user so that the user can hit again. For easy transport and storage, the rotation stick pivots downward and the legs pivot upwards so that they are all parallel with the rotation axis.

DETAILED DESCRIPTION OF THE PREFERRED EMBODIMENTS

Figures 1A, 2, 3, 4:
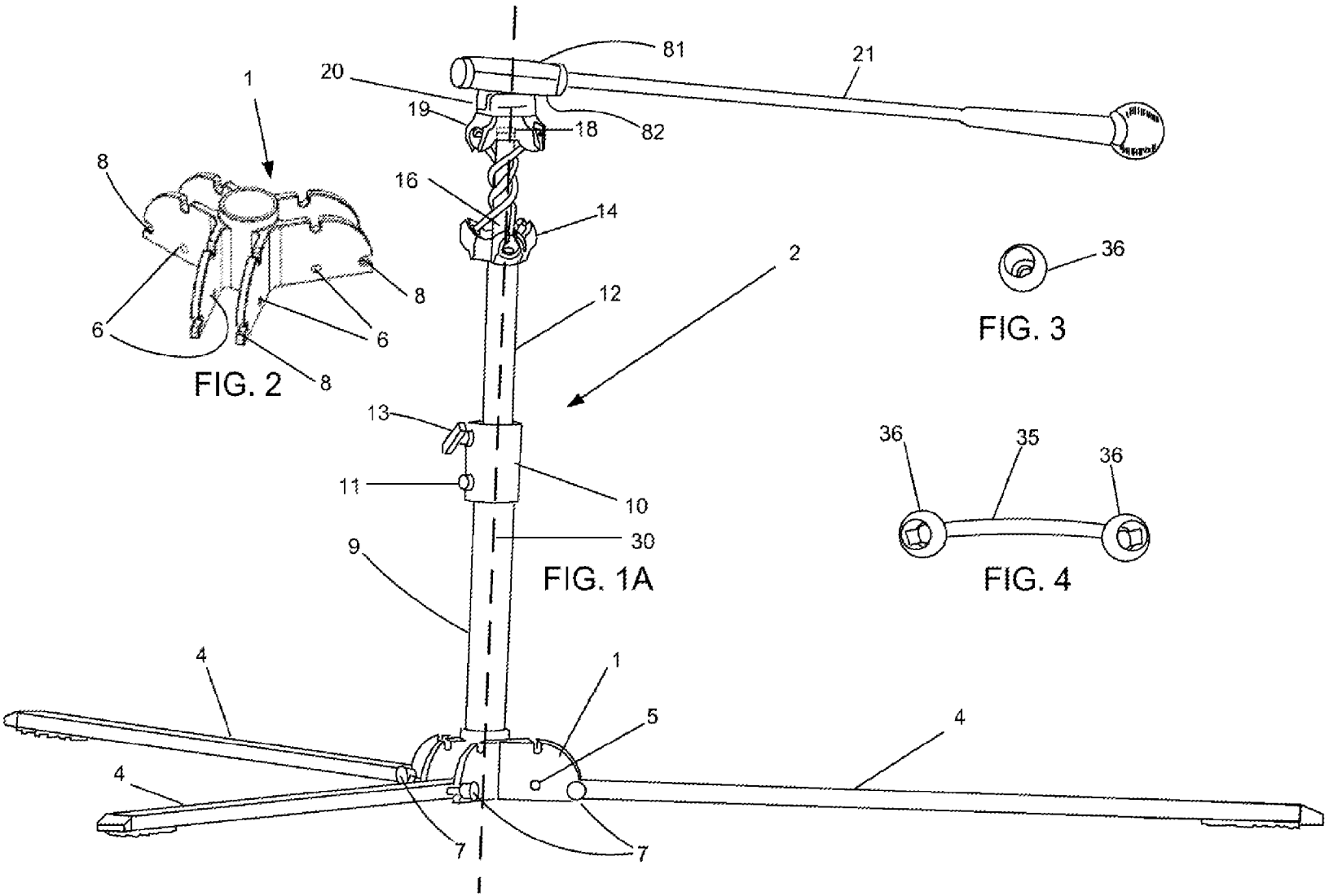
FIGS. 1A and 1B show a preferred embodiment of the present invention.
FIG. 2 shows a preferred base.
FIG. 3 shows a preferred band ball.
FIG. 4 shows a preferred band.
Figure 1B:
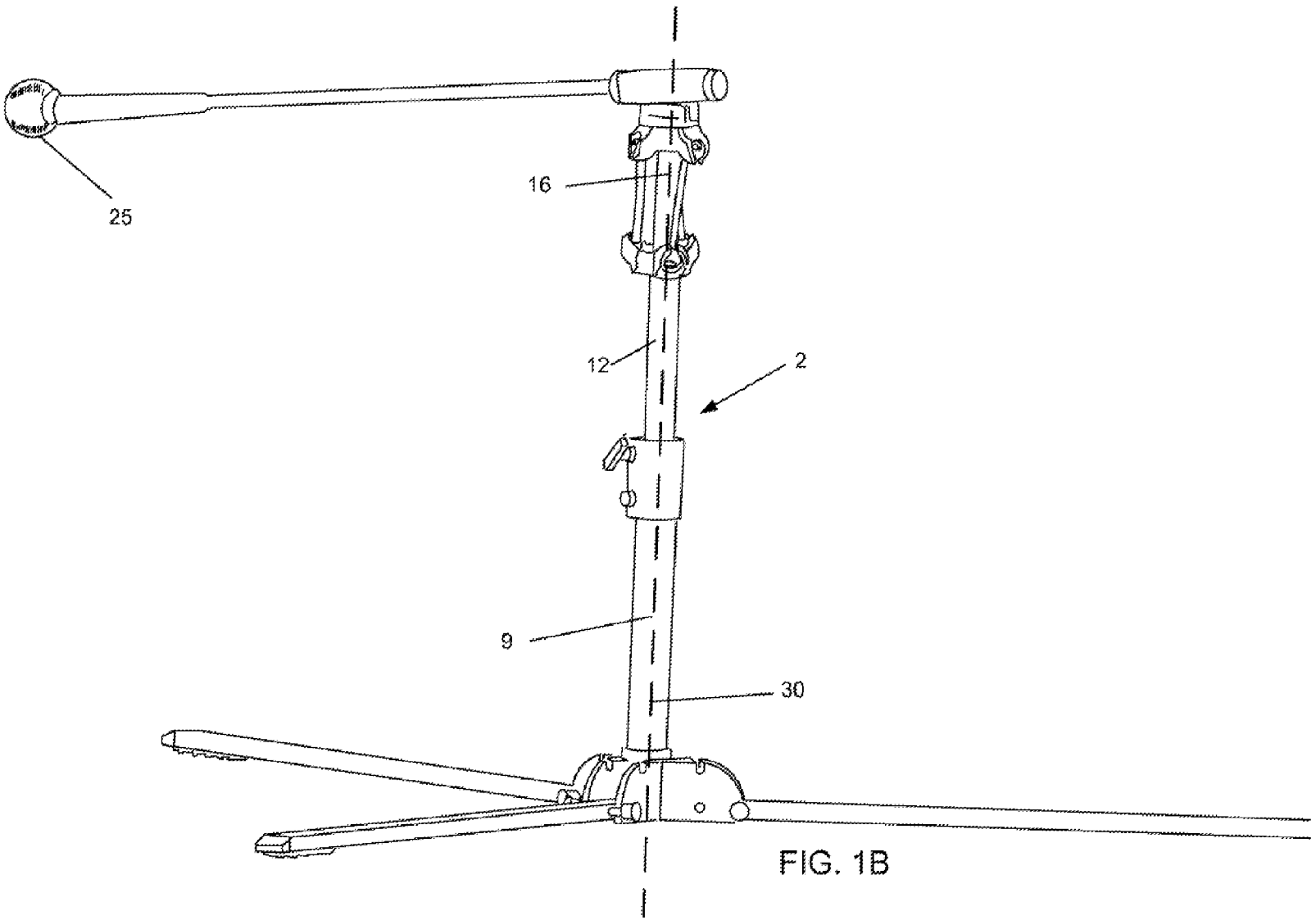

FIGS. 1A and 1B provide a simple illustration of the utilization of the present invention. In FIG. 1B, swing training device 2 is at a rest position. A left handed batter can now hit ball 25 and the ball will rotate counter clockwise about rotation axis 30 (i.e., the axis formed by bottom support tube 9, height adjustment tube 12 and band tube 16). FIG. 1A shows ball 25 after the left handed batter has hit it. Ball 25 has been treaded onto the end of rotation stick 21. In FIG. 1A, ball 25 has rotated multiple times around rotation axis 30 and bands 35 are wound tight around band tube 16. A spring force created by the stretched bands 35 will now cause ball 25 to rotate backwards (i.e., clockwise) multiple times simulating a pitch. The harder the batter hits the ball, the faster the pitch will be as it comes back to the batter. The batter can now hit the ball again and repeat this process for as long as he wishes eliminating the need for a pitcher or the need for chasing batted balls.

Components of a Preferred Embodiment

FIG. 1A shows a preferred embodiment of the present invention. Base 1 provides support for swing training device 2. In the preferred embodiment shown in FIG. 1A, three legs 4 are pivotally connected to base 1 as shown. Legs 4 pivot about bolt axis 5 which is attached through hole 6 (FIG. 2). As shown in FIG. 1A, spring loaded pull pins 7 are connected to legs 4 and engage slots 8 (FIG. 2) to hold legs 4 in a horizontal position.

Bottom support tube 9 is rigidly bolted to base 1. Height adjustment sleeve 10 is bolted to bottom support tube 9 via set screw 11. Height adjustment tube 12 is inserted into bottom support tube 9 through height adjustment sleeve 10. In a preferred embodiment, height adjustment tube 12 includes a height-stop mechanism that functions to prevent the separation of height adjustment tube from height adjustment sleeve 10 if the user raises height adjustment tube to its maximum height. For example, in one preferred embodiment height adjustment tubes 12 includes two button head screws attached to its lower end. The heads of the button head screws are just large enough to prevent the whole top part of the unit from being adjusted too much and separating. The button head screws are stopped by the smaller diameter of height adjustment sleeve 10.

The vertical position of height adjustment tube 12 can be adjusted by the user as desired by loosening and then tightening a height adjustment controller. For example in the preferred embodiment shown the height adjustment controller is threaded knob 13 and the height of height adjustment tube 12 is adjusted by loosening and then tightening threaded knob 13.

Figure 5:
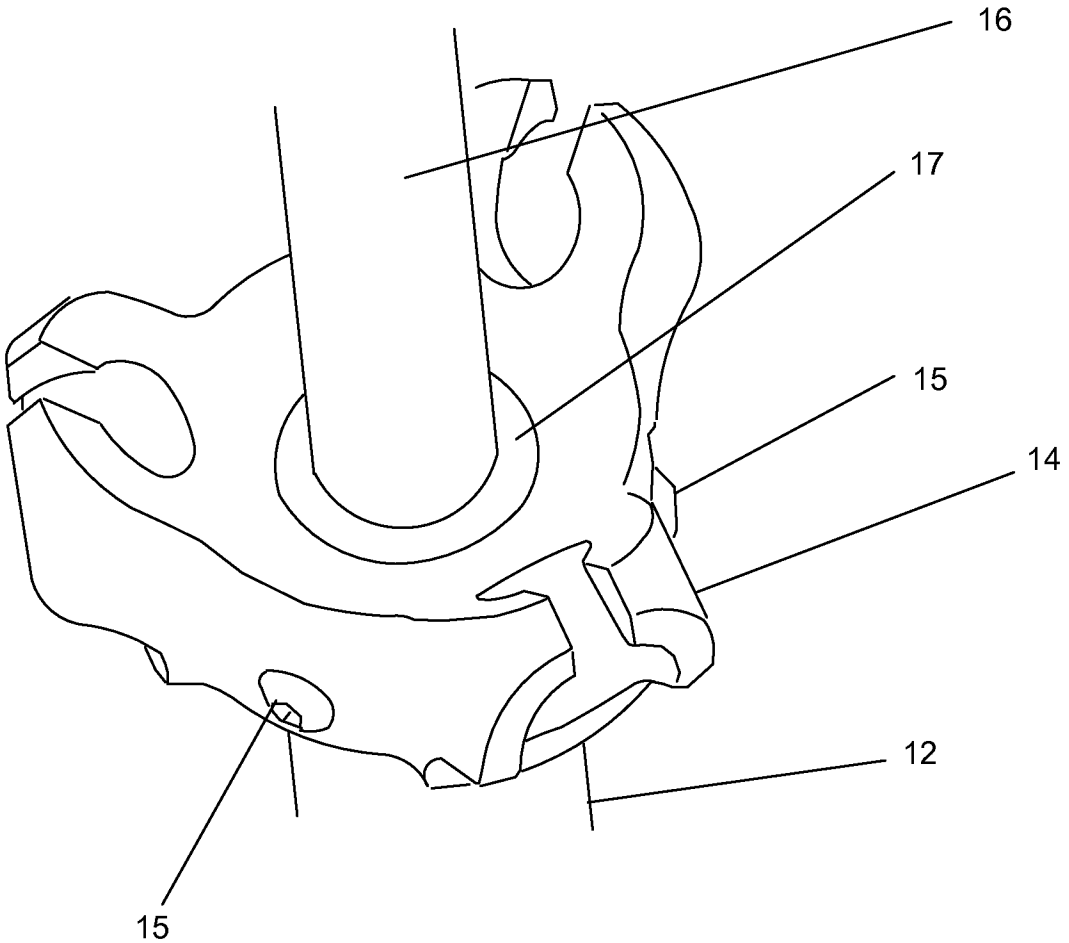
FIG. 5 shows a preferred lower band holder.
Figure 22:
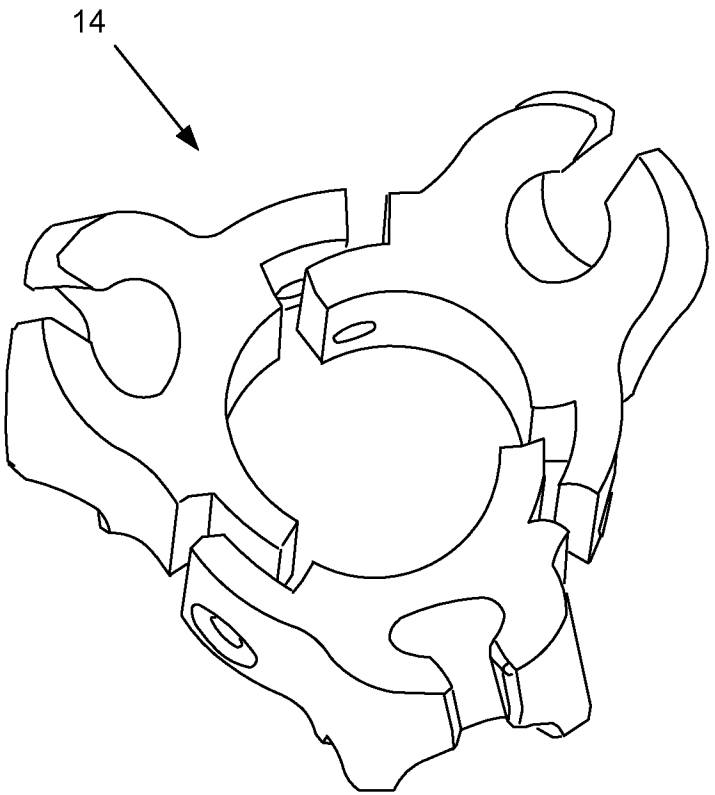

Lower band holder 14 is bolted to height adjustment tube 12. FIG. 5 shows a detailed view of lower band holder 14 bolted in place using bolts 15. In a preferred embodiment, lower band holder 14 lower band holder 14 is a three piece part that fits together (FIG. 22). Band tube 16 is supported by bearings 17 and 18 (see also FIGS. 5 and 6). Upper band holder 19 is bolted to pivot support piece 20. Pivot piece 20 is bolted to shaft 91. Rotation stick 21 is clamped tightly between upper stick holder 81 lower stick holder 82 (see also FIGS. 1A and 17). Lower stick holder 82 is pivotally connected to pivot piece 20 and can be locked in place at the angle desired by the user (FIG. 1A).

Bands

Figure 7:
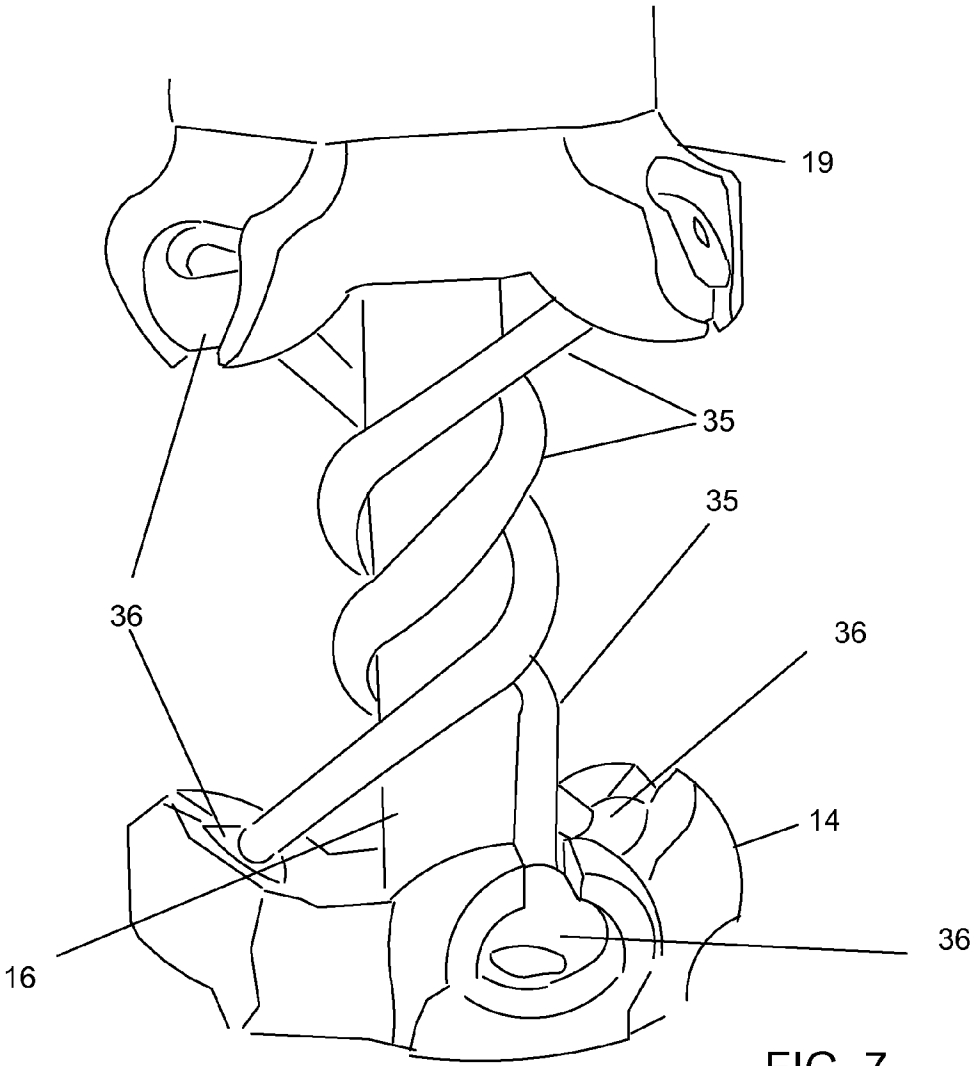
FIG. 7 shows stretched bands.

FIG. 4 shows a detailed view of band 35. Band 35 is preferably an elastic, rubbery band that will stretch and then regain its original size. Each end of band 35 is inserted into band ball 36. FIG. 3 shows a detailed view of band ball 36. FIG. 7 shows a detailed view of bands 35 wrapped tight around band tube 16. The spring force in elastic bands 35 will now cause ball 25 (see FIG. 1A) to rotate backwards (i.e., clockwise) multiple times simulating a pitch to a batter. The batter can now hit the ball again and repeat this process for as long as he wishes.

Preferred Height Adjustment Sleeve

Figure 21:
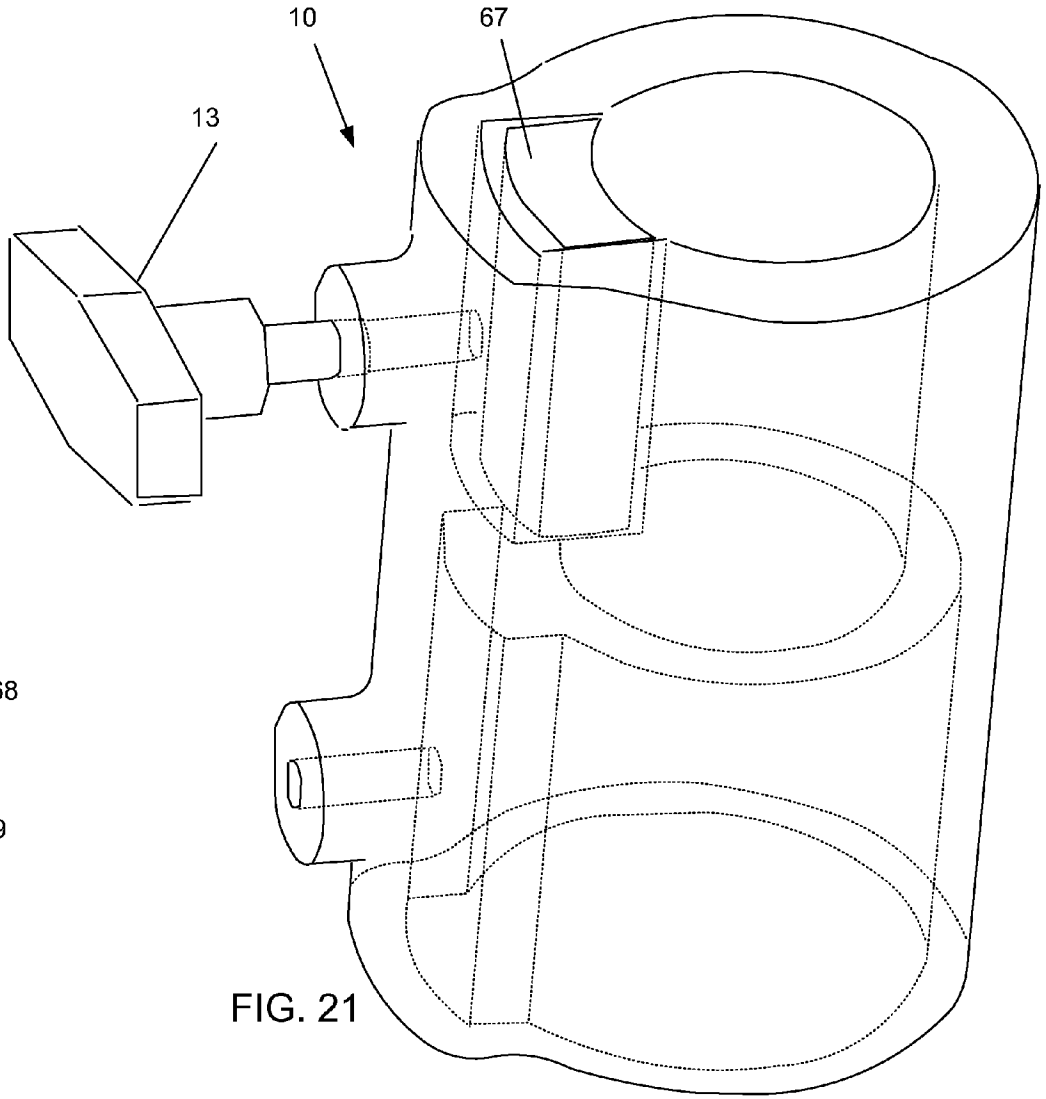
FIGS. 20 and 21 show a preferred height adjustment sleeve.
Figure 20:
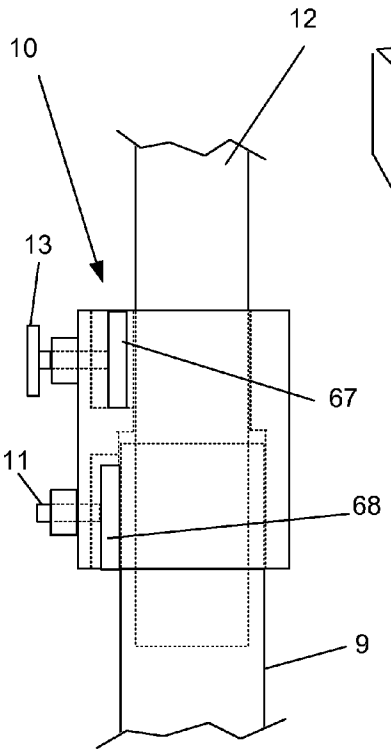

FIGS. 20 and 21 show details of preferred height adjustment sleeve 10. In FIG. 20, set screw 11 has been turned so that pressure pad 68 is pressed tightly against bottom support tube 9. Threaded knob 13 has been loosened. Height adjustment tube 12 can now be moved up or down to its desired location. To secure height adjustment tube 12 at its desired position the user will turn threaded knob 13 so that pressure pad 67 presses tightly against height adjustment tube 12.

Preferred Rotation Components

Figure 16A:
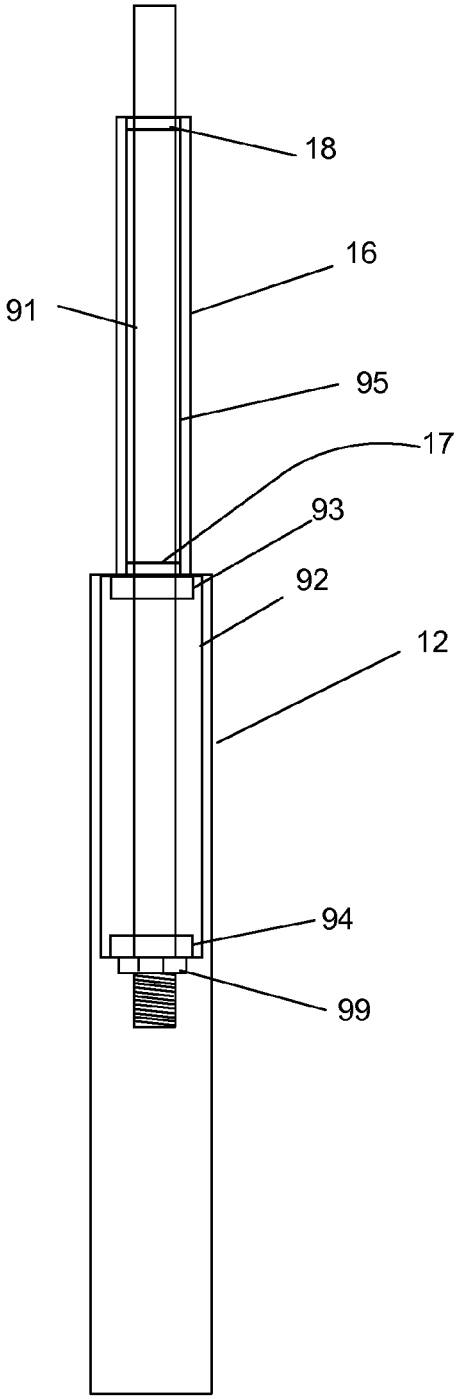
FIGS. 16A and 16B show preferred rotation components.
Figure 16B:
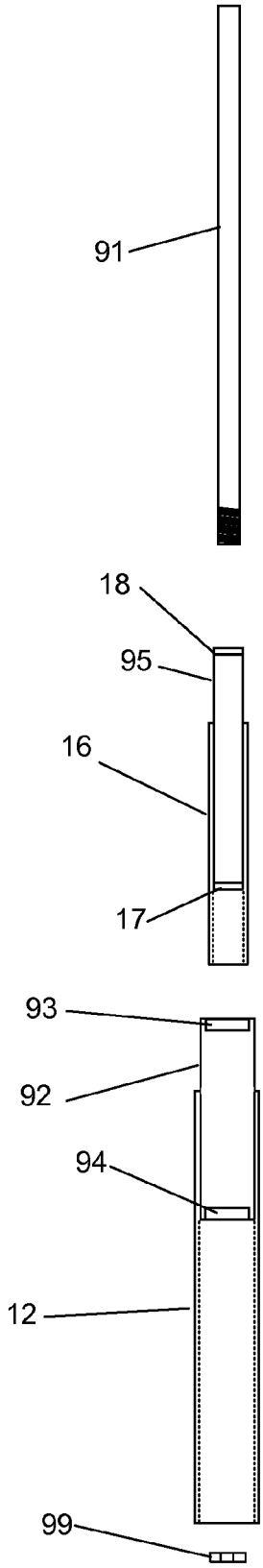

FIGS. 16A and 16B show a detailed drawing identifying the primary components associated with allowing for a smooth rotation about rotation axis 30 (FIG. 1A). Shaft 91 extends downward through band tube 16 and height adjustment tube 12. Pivot piece 20 (FIG. 1A) is bolted to shaft 91. Shaft 91 also extends through bearing sleave 92 and inner shaft tube 95. Bearing sleeve 92 holds main bearing 93 and main bearing 94. Main bearings 93 and 94 allow for the smooth rotation of rotation stick 21 about rotation axis 30. Inner shaft tube 95 is used as a bearing spacer. Band tube 16 is slightly longer and covers bearings 17 and 18 which allow band tube 16 to spin freely around inner shaft tube 95. Because band tube 16 spins freely, band tube 16 moves along with bands 35. Elastic bands 35 grab onto band tube 16 so that they move together in order to eliminate rubbing and grinding of the bands that would otherwise occur. The above described preferred rotation components are held together tightly by nut 99.

Rotation Stick Attachment

Figure 17:
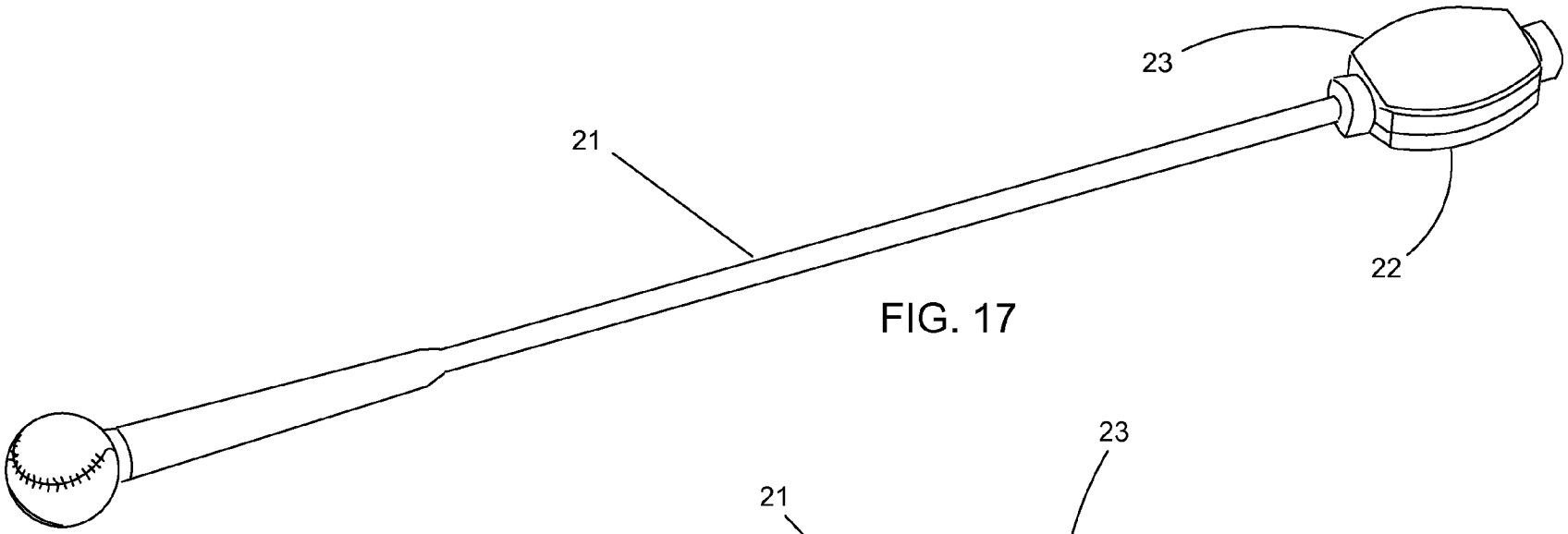
FIGS. 17-19 show a preferred rotation stick.
Figure 18:
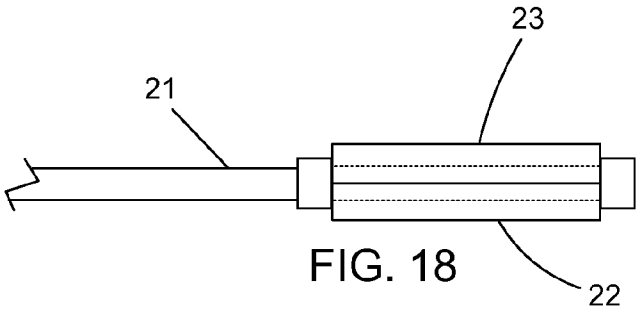
Figure 19:
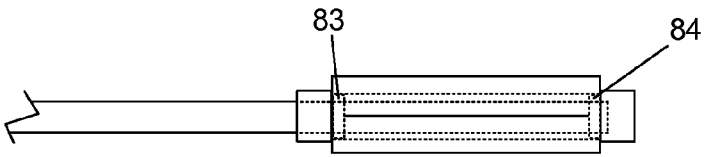

FIGS. 17-19 show the connection of rotation stick 21. As explained above, rotation stick 21 is clamped between top stick support piece 23 and bottom stick support piece 22. In the preferred embodiment shown in FIG. 18, top stick support piece 23 and lower stick holder 82 clamp tightly onto stick 21 so that there is no spinning of the stick. In the preferred embodiment shown in FIG. 19, bearings 83 and 84 are connected to stick 21. Spinning tube 85 rides on bearings 83 and 84. Top stick support piece 23 and bottom stick support piece 22 clamp tightly onto tube 85 allowing for free spinning of rotation stick 21. The spinning rotation stick allows for ball 25 to also spin. The spinning ball 25 more closely resembles a true pitch as the ball spins through the air. This provides better training for the batter.

Stowage, Transport and Set Up

Figure 6:
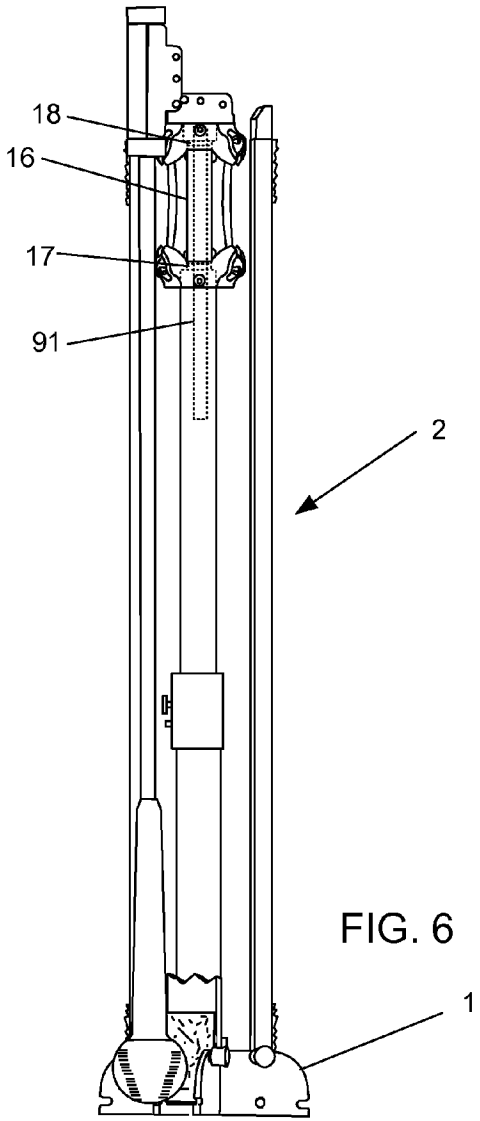
FIG. 6 shows a preferred embodiment of the present invention folded and ready for carrying and storage.

FIG. 6 shows swing training device 2 as it has been folded for storage or transport. In the position shown in FIG. 6, swing training device is approximately 3.5 feet×8 inches×8 inches and weights approximately 17 pounds. It can easily be stowed into a carrying bag and carried by a 9 year old child of ordinary strength.

In FIG. 6 the user has set swing training device 2 upright so that it is resting on base 1.

Figures 8, 9, 10:
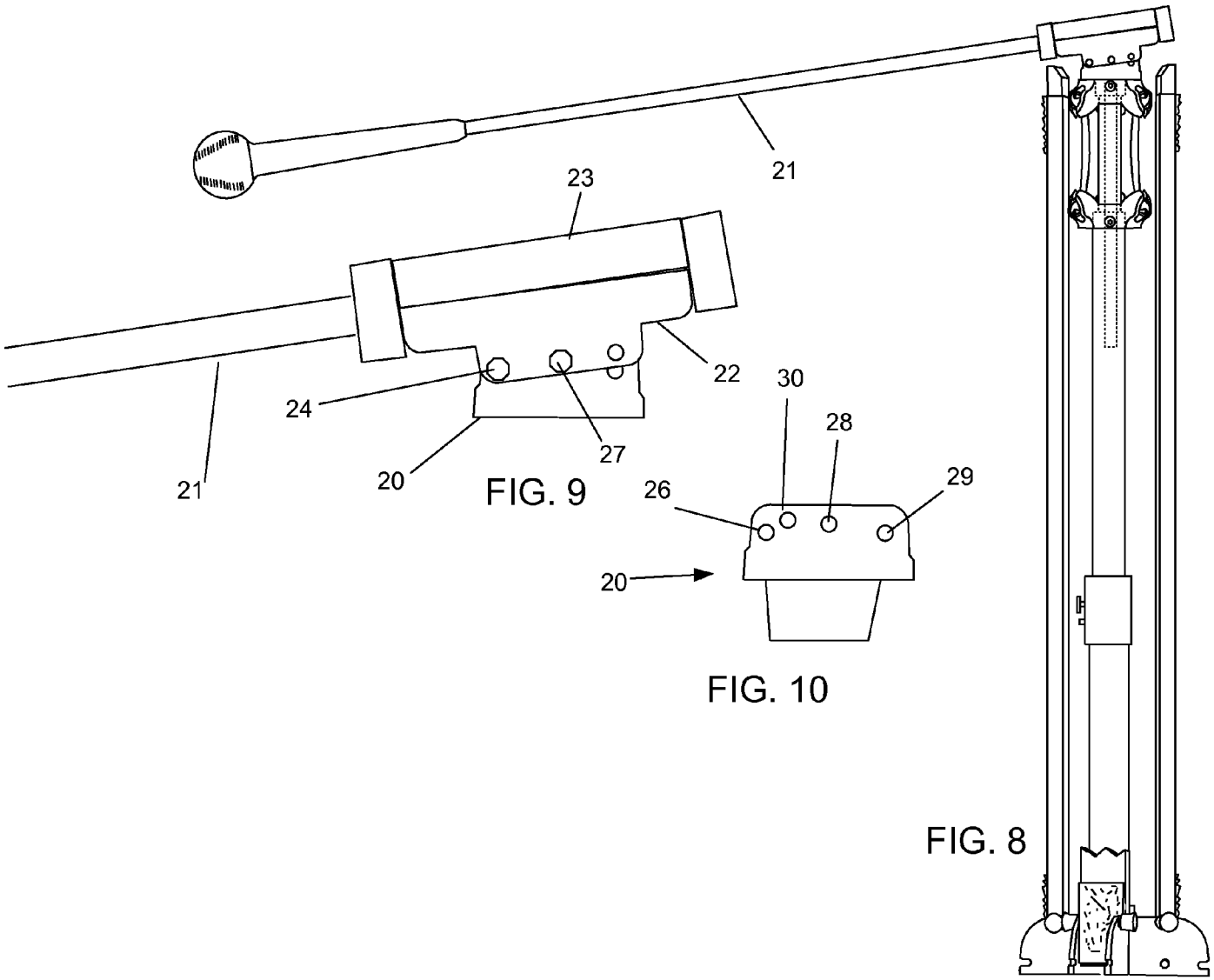
FIGS. 8-10 show a raised rotation stick.

In FIG. 8 the user has pivoted rotation stick 21 upward so that it is in the tilted position shown. FIG. 9 shows a detailed view of rotation stick 21, pivot piece 20, bottom stick support piece 22 and top stick support piece 23. FIG. 10 shows details of pivot piece 20. Pivot bolt 24 is permanently inserted through the leftmost hole of bottom stick support piece 22 and through hole 26 of pivot piece 20. Rotation stick 21 pivots about the axis formed by pivot bolt 24. To lock rotation stick 21 in the position shown in FIG. 9 bolt 27 is inserted through the middle hole of bottom stick support piece 22 and through hole 28 of pivot piece 20.

Figure 11:
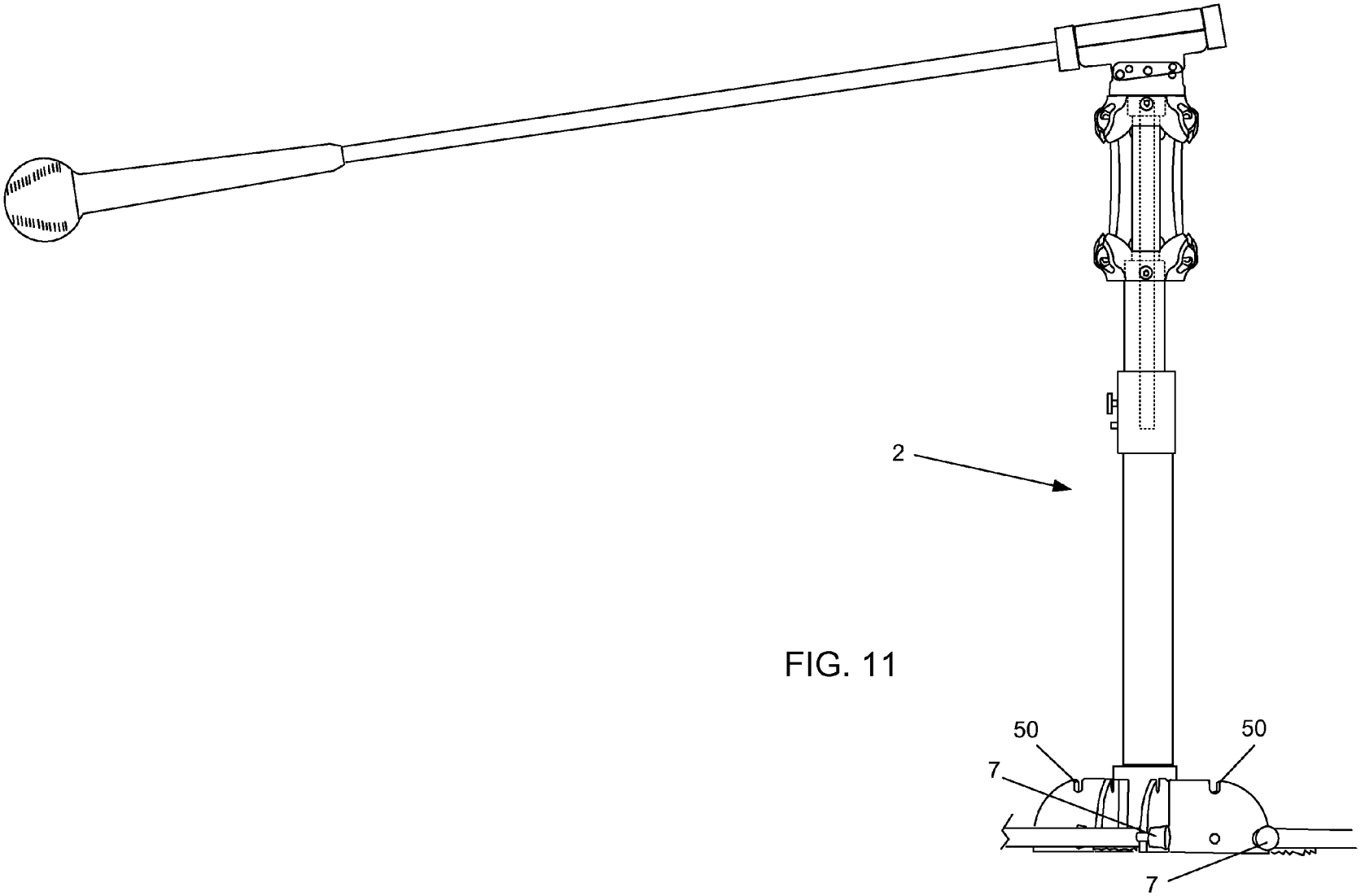
FIG. 11 shows lowered legs.

In FIG. 11 the user has disengaged pull pins 7 from upper slots and has pivoted legs 4 downward to their horizontal position. Pull pins 7 are engaged in lower slots 8 (FIG. 2) to lock legs 4 into the horizontal position. Swing training device 2 is now ready for use.

Figures 12, 12B:
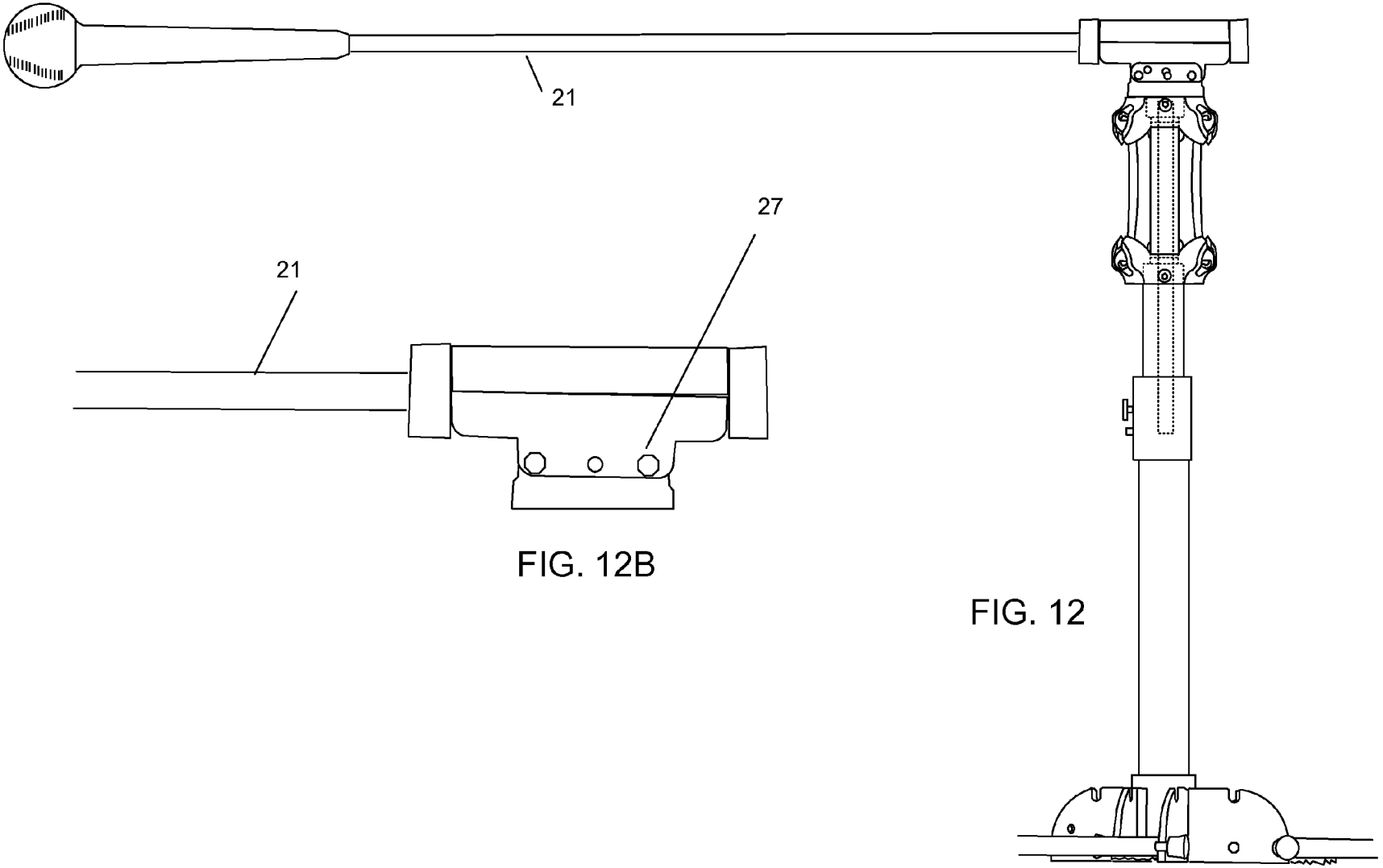
FIGS. 12-12B show the rotation stick in a horizontal position.

In FIG. 12 the user has decided that he would like rotation stick 21 to be horizontal rather than tilted downward. Bolt 27 has been inserted through the rightmost hole of bottom stick support piece 22 and through hole 29 of pivot piece 20 (FIG. 12B and FIG. 10).

Figure 13:
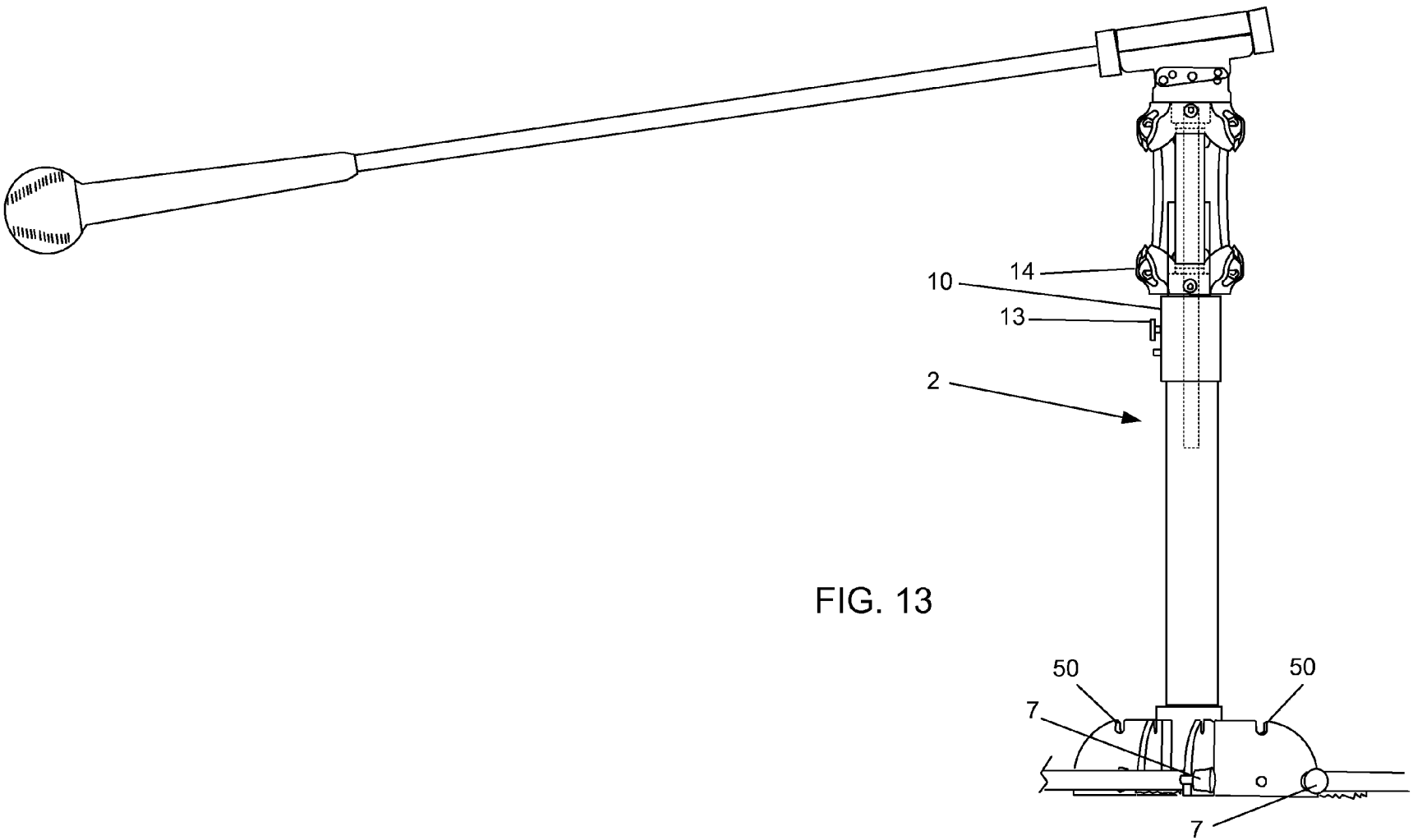
FIG. 13 shows the height adjusted for a very small child.

In FIG. 13 the user has decided that he would like to set up swing training device 2 for a very small child. Therefore the user has loosened threaded knob 13, lowered height adjustment tube 12 all the way so that lower band support 14 is flush with height adjustment sleeve 10. The user has then tightened threaded knob 13 to lock the position as shown.

Figure 15:
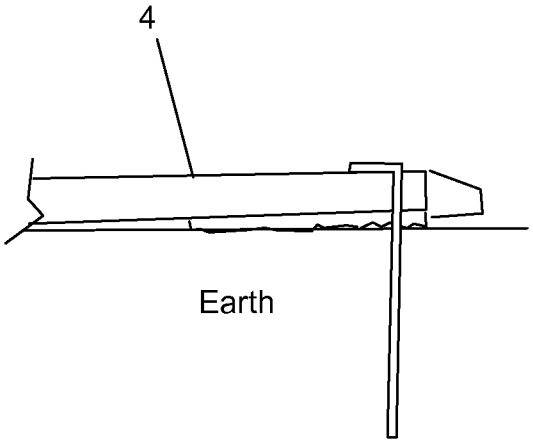
FIG. 15 shows a leg staked to the ground.

To better secure swing training device 2 to the earth, in FIG. 15 the user has staked each leg 4 to the ground by inserting stakes 63 through each leg 4. This helps prevent swing training device from having undesired motion during usage. In a preferred embodiment, stakes 63 are inserted into an earth at an angle rather than straight up and down. Inserting stakes 63 at an angle increases their ability to hold legs 4 to the ground.

Figure 14:
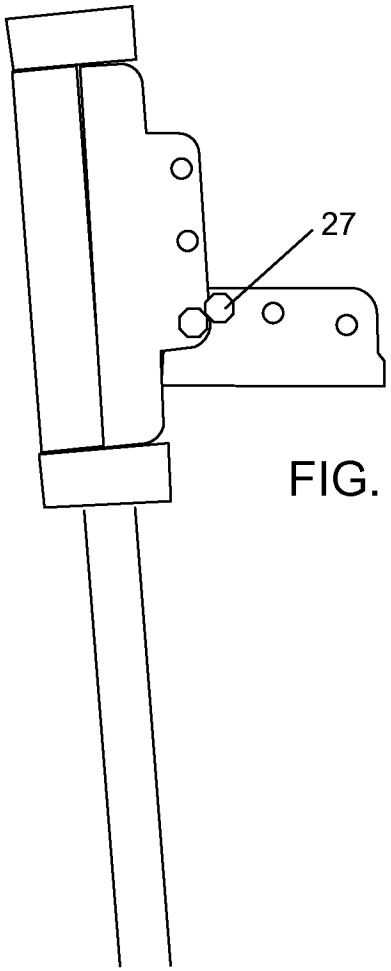
FIG. 14 shows the rotation stick in a vertical position.

When the user is finished training with swing training device 2, he can put swing training device 2 back into the position shown in FIG. 6 by reversing the above described steps. To lock rotation stick 21 in the position shown in FIG. 6 the user inserts bolt 27 through hole 30 of pivot piece 20 (FIGS. 10 and 14).

Preferred Materials

In a preferred embodiment the major structural components of the present invention (for example, bottom support tube 9, height adjustment tube 12 and band tube 16) are fabricated from aluminum. Aluminum provides high strength and is light weight. Elastic bands 35 are preferably fabricated from rubber.

Prototype

Applicant has successfully built and tested a prototype of swing training device 2. He has had very positive feedback from adults and children. Expert baseball players as well as beginners have found great benefit from swing training device 2. Kids especially like to practice with it and have successfully improved their swings.

Although the above-preferred embodiments have been described with specificity, persons skilled in this art will recognize that many changes to the specific embodiments disclosed above could be made without departing from the spirit of the invention. For example, although FIG. 14 shows legs 4 staked to the ground, it is also possible to secure legs 4 by resting something heavy on top of them. In one preferred embodiment the user places a sandbag on top of each leg 4 to better secure swing training device 2 to the ground. Therefore, the attached claims and their legal equivalents should determine the scope of the invention.

What is claimed is:

1. A swing training device, comprising:

A) a base,

B) a plurality of legs pivotally connected to said base,

C) a bottom support tube rigidly connected to said base,

D) a height adjustment tube insertable into said bottom support tube,

E) a height adjustment controller connected to said bottom support tube and said height adjustment tube, said height adjustment controller for adjusting the height of said height adjustment tube, F) a lower band holder rigidly connected to said height adjustment tube, G) an upper band holder, H) a pivot piece rigidly connected to said upper band holder, I) a rotation stick pivotally connected to said pivot piece at a rotation stick first end, J) a hittable ball connected to rotation stick at a rotation stick second end, K) a band tube positioned between said lower band holder and said upper band holder, L) a plurality of elastic bands connected between said upper band holder and said lower band holder, wherein each of said plurality of elastic bands comprises band balls connected at both ends, wherein said band balls engage said upper band holder and said lower band holder to hold said plurality of elastic bands in place and, wherein said bottom support tube, said height adjustment tube and said band tube form a rotation axis, wherein said hittable ball and said rotation stick rotate about said rotation axis in an initial rotation direction causing said plurality of elastic bands to stretch and to wrap around said band tube when said hittable ball is hit by a user, wherein said stretched plurality of elastic bands act as a spring to cause said hittable ball and said rotation stick to rotate back in an opposite rotation direction to simulate a pitch to the user so that the user can hit said hittable ball repeatedly.

2. The swing training device as in claim 1, wherein said pivot piece allows locks said rotation stick in a plurality of selectable pivot locations.

3. The swing training device as in claim 2, wherein said plurality of selectable pivot locations comprise:

A) a horizontal rotation stick selection,

B) a slightly tilted rotation stick selection, and

C) a vertical rotation stick selection for easy transport and storage.

4. The swing training device as in claim 1, wherein said swing training device is foldable for easy carrying and storage by pivoting said plurality of legs so that they are parallel with said rotation axis and by pivoting said rotation stick so that it is parallel with said rotation axis.

5. The swing training device as in claim 1, wherein said height adjustment controller is a height adjustment sleeve bolted to said bottom support tube and threaded knob for loosening and tightening against said height adjustment tube.

6. The swing training device as in claim 1 further comprising a band tube bearing connected at each end of said band tube, wherein said band tube bearings support said band tube between said upper band tube holder and said lower band tube holder.

7. The swing training device as in claim 1, wherein said base comprises a lower pivot location for horizontal placement of said plurality of legs and wherein said base comprises a vertical pivot location for vertical placement of said legs for easy transport and storage.

* * * * *